US009987544B2

(12) United States Patent
Sodec, Jr.

(10) Patent No.: US 9,987,544 B2
(45) Date of Patent: Jun. 5, 2018

(54) SAFER FOOTBALL HELMET

(71) Applicant: John Sodec, Jr., Niceville, FL (US)

(72) Inventor: John Sodec, Jr., Niceville, FL (US)

( * ) Notice: Subject to any disclaimer, the term of this patent is extended or adjusted under 35 U.S.C. 154(b) by 0 days. days.

(21) Appl. No.: 15/803,760

(22) Filed: Nov. 4, 2017

(65) Prior Publication Data

US 2018/0056168 A1 Mar. 1, 2018

Related U.S. Application Data

(63) Continuation-in-part of application No. 14/999,161, filed on Apr. 5, 2016.

(51) Int. Cl.
*A63B 71/10* (2006.01)
*A42B 3/06* (2006.01)

(52) U.S. Cl.
CPC ..... *A63B 71/10* (2013.01); *A42B 3/064* (2013.01)

(58) Field of Classification Search
CPC ..... A63B 71/10
USPC ..... 2/412, 425
See application file for complete search history.

(56) References Cited

U.S. PATENT DOCUMENTS 3,153,242 A * 10/1964 Nedwick ..... A42B 3/064 2/411
3,435,460 A * 4/1969 Munro ..... A42B 3/06 2/422
4,012,794 A * 3/1977 Nomiyama ..... A42B 3/064 2/411
4,185,331 A * 1/1980 Nomiyama ..... A42B 3/00 2/411
4,937,888 A * 7/1990 Straus ..... A42B 3/003 2/411
6,658,671 B1 * 12/2003 Von Holst ..... A42B 3/064 2/412
6,996,856 B2 * 2/2006 Puchalski ..... A42B 3/064 2/411
8,015,624 B2 * 9/2011 Baldackin ..... A42B 3/065 2/412
9,179,727 B2 * 11/2015 Grant ..... A42B 3/064
9,642,410 B2 * 5/2017 Grice ..... A42B 3/06
9,820,525 B2 * 11/2017 Weber ..... A42B 3/064
2006/0005291 A1 * 1/2006 Bedford ..... A42B 3/285 2/7
2016/0021965 A1 * 1/2016 Mayerovitch ..... A42B 3/12 2/414

(Continued)

FOREIGN PATENT DOCUMENTS

WO WO-2015012583 A1 * 1/2015 ..... A42B 3/065

*Primary Examiner* — Joshua T Kennedy
(74) *Attorney, Agent, or Firm* — Chen-Chi Lin

(57) ABSTRACT

A football helmet comprises a rotatable outer shell, an inner shell and a fastener assembly. The inner shell comprises an upper portion and a lower portion. The rotatable outer shell is of a hollow hemisphere shape. The rotatable outer shell has a cavity to receive the upper portion of the inner shell. An air gap is between the upper portion of the inner shell and the rotatable outer shell. A pre-determined torque is applied to a nut of the fastener assembly so that the nut is loosely tightened to a bolt of the fastener assembly. The rotatable outer shell is in a pogo stick motion when a force is applied to the rotatable outer shell so that the ring rotates along the rim track and an outer shell hole deflects toward an inner shell hole.

4 Claims, 6 Drawing Sheets

(56) References Cited

U.S. PATENT DOCUMENTS

| | | | | |
|---|---|---|---|---|
| 2016/0278469 | A1* | 9/2016 | Williams | A42B 3/063 |
| 2017/0231312 | A1* | 8/2017 | Halldin | A42B 3/064 2/416 |

* cited by examiner

SAFER FOOTBALL HELMET

CROSS-REFERENCE TO RELATED APPLICATIONS

This Patent Application is a Continuation-in-part application of a pending application Ser. No. 14/999,161 filed on Apr. 5, 2016. The Disclosure made in the patent application Ser. No. 14/999,161 is hereby incorporated by reference.

FIELD OF THE INVENTION

This invention relates generally to a football helmet. More particularly, the present invention relates to a football helmet having a rotatable outer shell, an inner shell and a fastener assembly.

BACKGROUND OF THE INVENTION

Professionals and amateurs wear football helmets to reduce chances of head injuries while playing American football games. A plastic helmet was introduced in 1940 by Riddell. In the same year, Riddell also developed a first chin strap to engage with a user's chin instead of the user's neck. In 1955, G. E. Morgan, a consultant to Riddell, and Paul Brown, the coach of the Cleveland Browns, invented the BT-5 face mask which is a single-bar design. In the late 1976, because of requirement for safety, four chin straps were required in college football games.

The football helmet of the present disclosure includes two shells (an rotatable outer shell engaging with an inner shell) and a bolt in a top crown area connecting the two shells. An advantage of the football helmet of the present disclosure is to significantly reduce impact forces at the rotatable outer shell being transferred to the inner shell.

SUMMARY OF THE INVENTION

A football helmet comprises a rotatable outer shell, an inner shell and a fastener assembly. The inner shell comprises an upper portion and a lower portion. The rotatable outer shell is of a hollow hemisphere shape. The upper portion of the inner shell is of a hollow hemisphere shape. The rotatable outer shell has a cavity to receive the upper portion of the inner shell. An air gap is between the upper portion of the inner shell and the rotatable outer shell.

A pre-determined torque is applied to a nut of the fastener assembly so that the nut is loosely tightened to a bolt of the fastener assembly. A ring of the rotatable outer shell is rotatable along a rim track of the inner shell. The rotatable outer shell is in a pogo stick motion when a force is applied to the rotatable outer shell so that the ring rotates along the rim track and an outer shell hole deflects toward an inner shell hole.

DETAILED DESCRIPTION OF THE INVENTION

Figure 1:
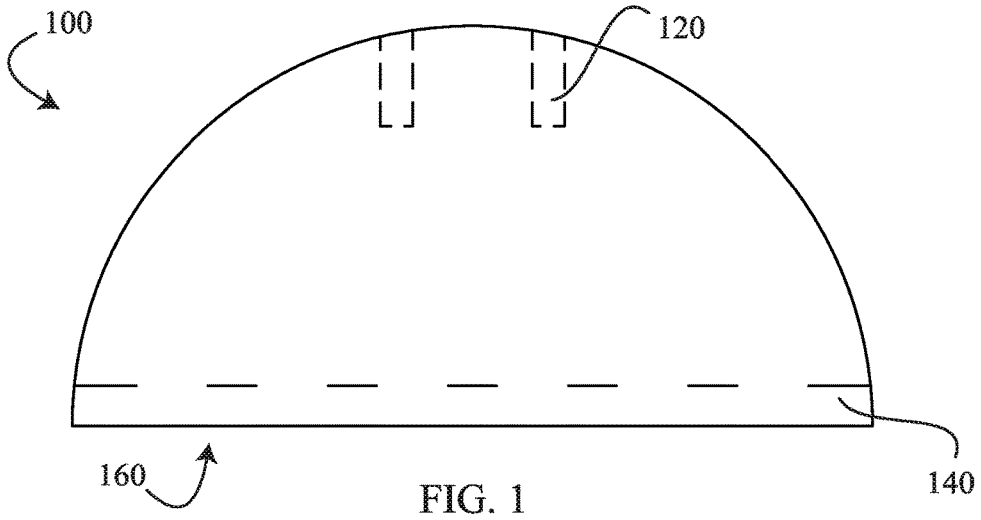
FIG. 1 shows a front view of an rotatable outer shell of a football helmet in examples of the present disclosure.
Figure 2:
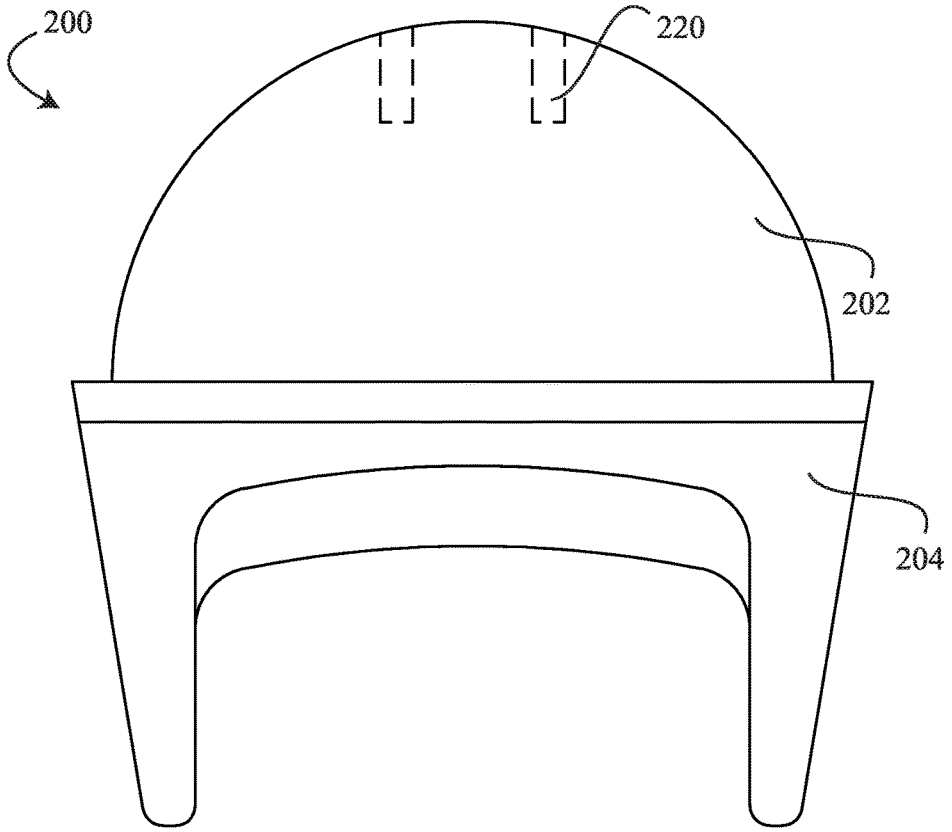
FIG. 2 shows a front view of an inner shell of the football helmet in examples of the present disclosure.
Figure 3:
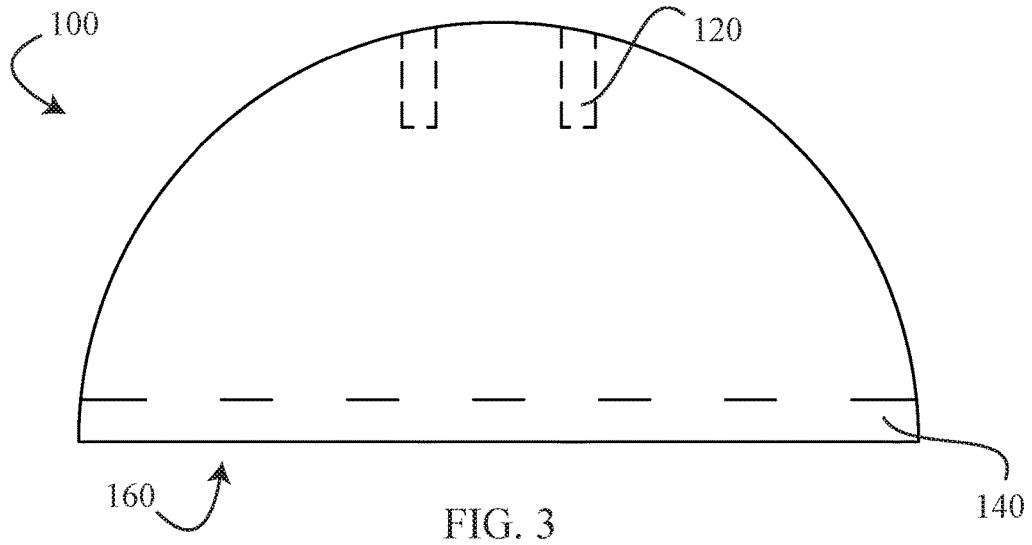
FIG. 3 shows a rear view of the rotatable outer shell of FIG. 1 in examples of the present disclosure.
Figure 4:
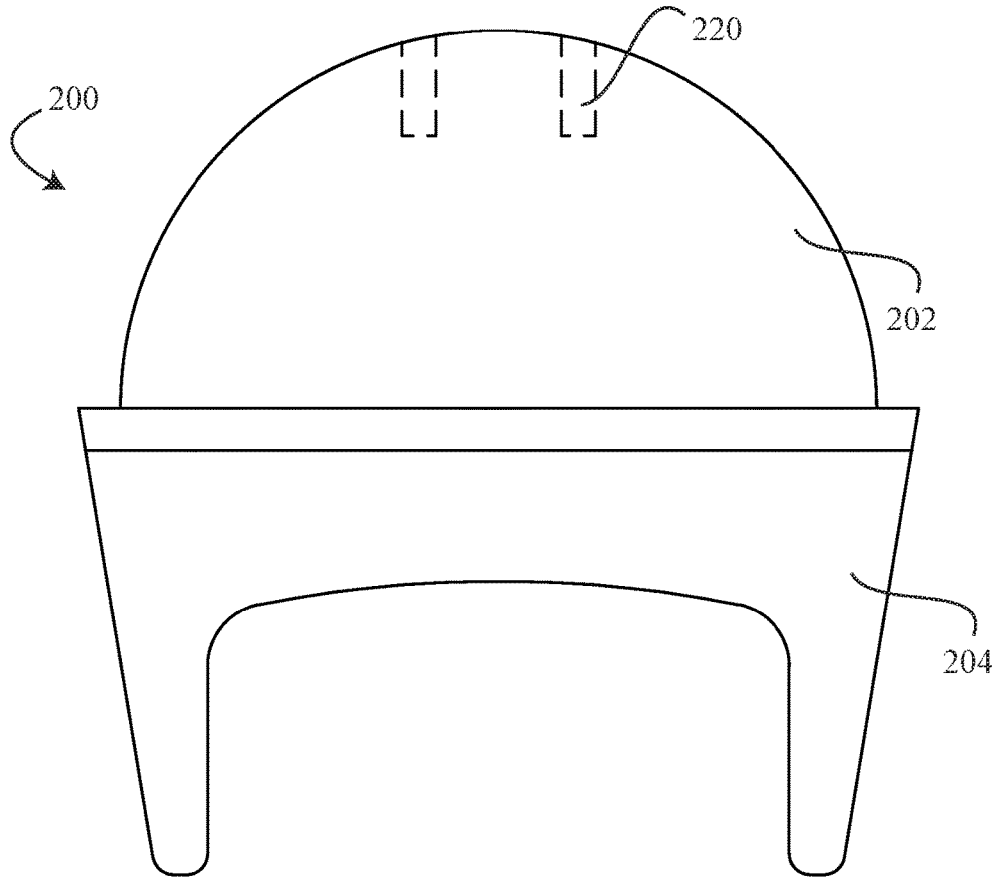
FIG. 4 shows a rear view of the inner shell of FIG. 2 in examples of the present disclosure.

FIG. 1 and FIG. 3 show a front view and a rear view of a rotatable outer shell 100 of a football helmet (integration of the rotatable outer shell 100 and an inner shell 200) respectively in examples of the present disclosure. FIG. 2 and FIG. 4 show a front view and a rear view of the inner shell 200 of the football helmet respectively in examples of the present disclosure. The football helmet comprises the rotatable outer shell 100, the inner shell 200 and a fastener assembly (for example, a fastener assembly 1180 of FIG. 11). The inner shell 200 comprises an upper portion 202 and a lower portion 204. The rotatable outer shell 100 further having a cavity 160 to accommodate the upper portion 202 of the inner shell 200. An air gap (for example, air gap 988 of FIG. 9) is between the upper portion of the inner shell 200 and the rotatable outer shell 100. In examples of the present disclosure, the rotatable outer shell 100 is of a hollow hemisphere shape and the upper portion 202 of the inner shell 200 is of a hollow hemisphere shape.

In examples of the present disclosure, a trim 140 of a ring shape is attached to a lower end of the rotatable outer shell 100. The trim 140 is optional, may be with no helmet track and is drawn in dashed lines in FIGS. 1 and 3. In one example, the trim 140 is made of a damping material including 3M NVH 04274.

In examples of the present disclosure, the rotatable outer shell 100 includes one or more ventilation slots 120. The upper portion 202 of the inner shell 200 includes one or more ventilation slots 220. The ventilation slots 120 and the ventilation slots 220 are optional and are drawn in dashed lines in FIGS. 1-4. In examples of the present disclosure, a selected ventilation slot of the one or more ventilation slots 220 of the inner shell 200 is aligned with a selected ventilation slot of the one or more ventilation slots 120 of the rotatable outer shell 100. A center of the hollow hemisphere shape of the rotatable outer shell 100, a center of the selected ventilation slot of the one or more ventilation slots 220 and a center of the selected ventilation slot of the one or more ventilation slots 120 are aligned along a straight line.

In one example, the inner shell 200 and the rotatable outer shell 100 are made of a molded polycarbonate material. In another example, the inner shell 200 and the rotatable outer shell 100 are made of steel or aluminum. In still another example, the inner shell 200 and the rotatable outer shell 100 are made of vinyl nitrile.

Figure 5:
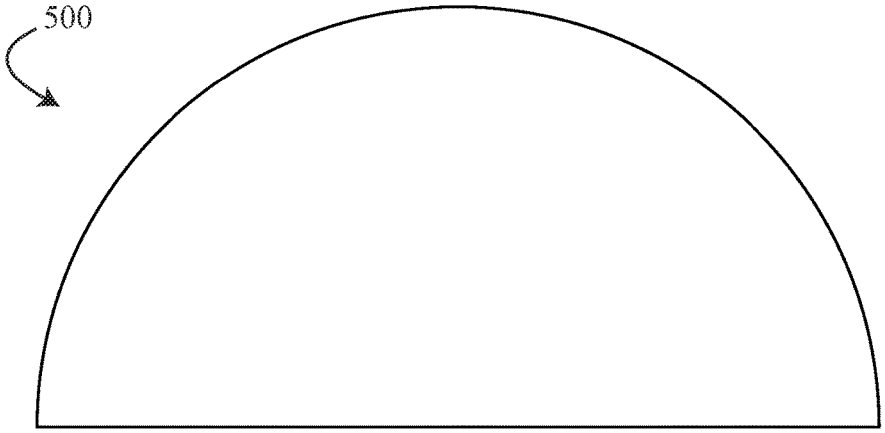
FIG. 5 shows a side view of an outer shell of a football helmet in examples of the present disclosure.
Figure 6:
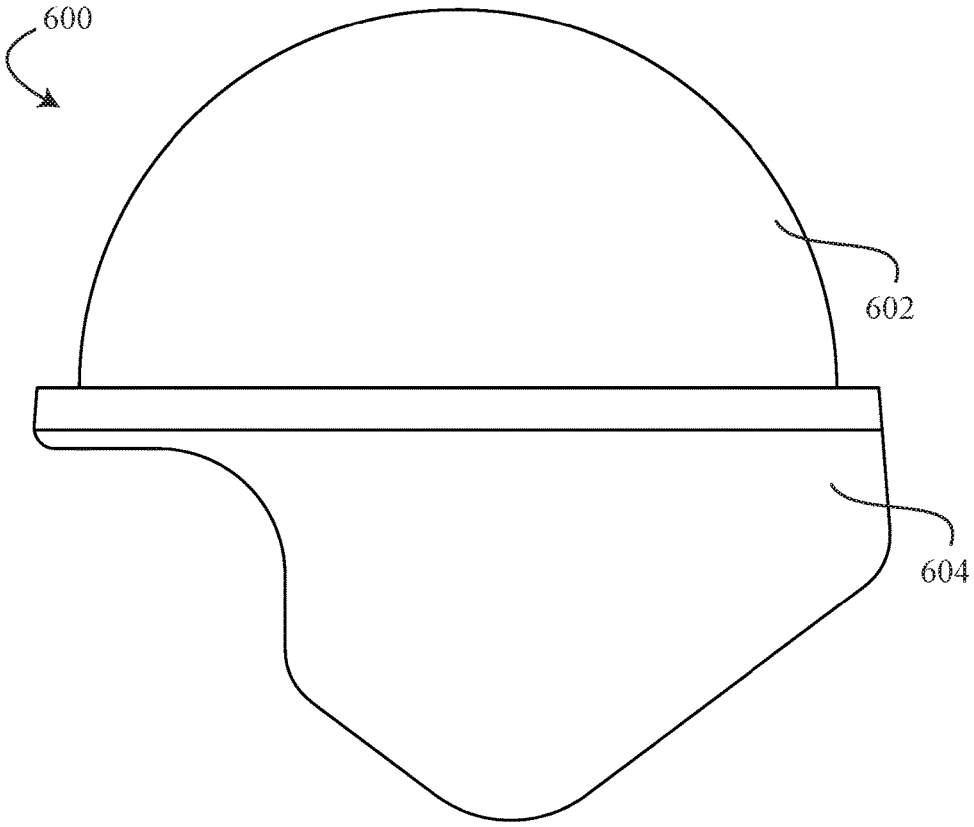
FIG. 6 shows a side view of an inner shell of the football helmet in examples of the present disclosure.

FIG. 5 shows a side view of an outer shell 500 of a football helmet in examples of the present disclosure. FIG. 6 shows a side view of an inner shell 600 of the football helmet in examples of the present disclosure. The inner shell 600 comprises an upper portion 602 and a lower portion 604.

Figure 7:
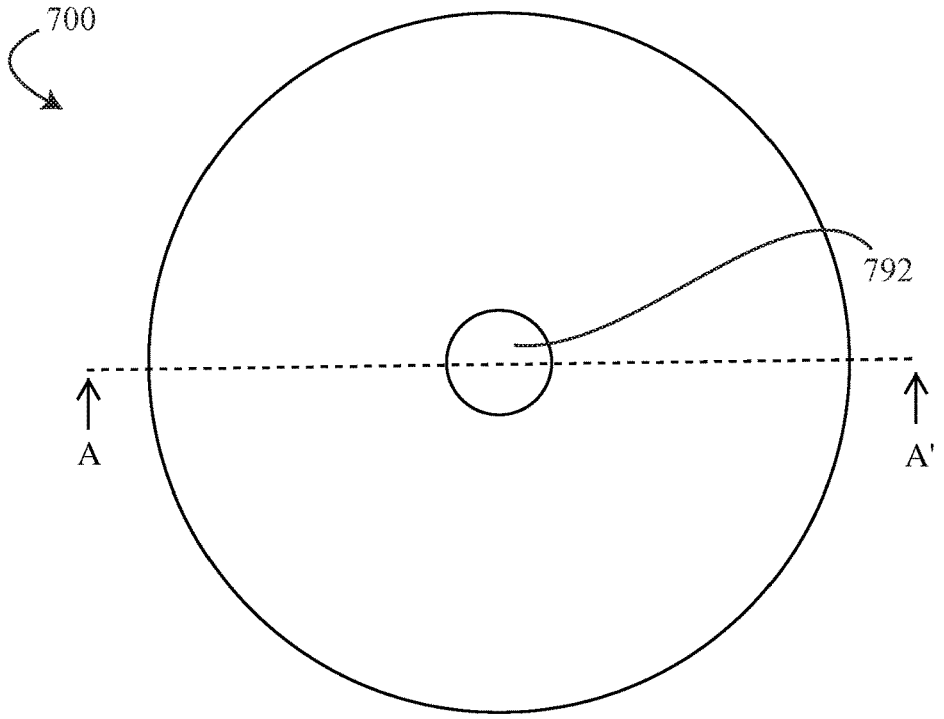
FIG. 7 shows a top view of an outer shell of a football helmet in examples of the present disclosure.
Figure 8:
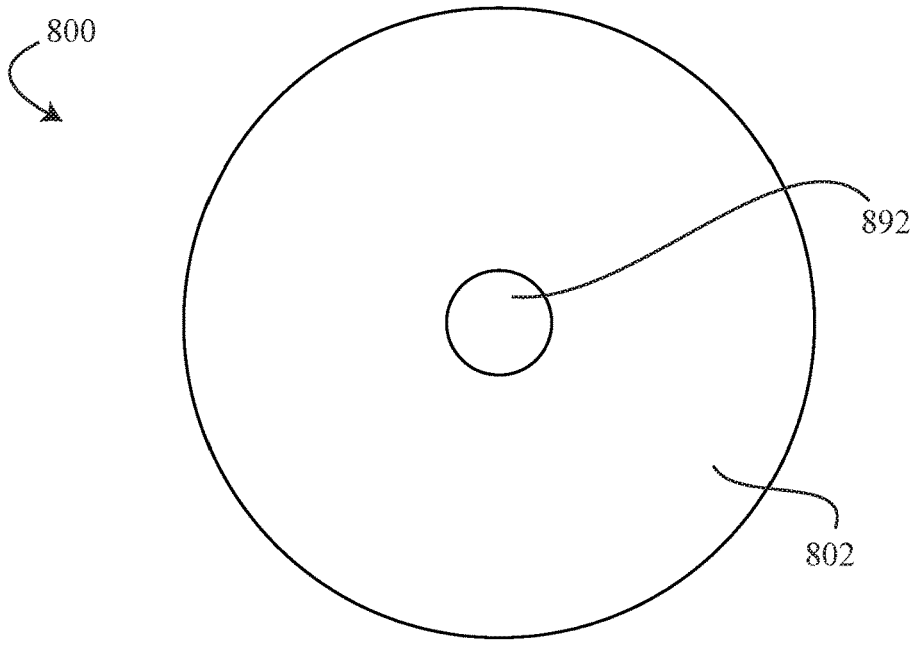
FIG. 8 shows a top view of an inner shell of the football helmet in examples of the present disclosure.

FIG. 7 shows a top view of an outer shell 700 of a football helmet in examples of the present disclosure. The rotatable outer shell 700 includes an outer shell hole 792 to receive a bolt of a fastener assembly. FIG. 8 shows a top view of an inner shell 800 of the football helmet in examples of the present disclosure. The inner shell 800 has an upper portion 802. The upper portion 802 of the inner shell 800 includes an inner shell hole 892 to receive a bolt of a fastener assembly. In examples of the present disclosure, from top views, the outer shell hole 792 is at a center of a peripheral of the rotatable outer shell 700 and the inner shell hole 892 is at a center of a peripheral of upper portion 802 of the inner shell 800.

Figure 9:
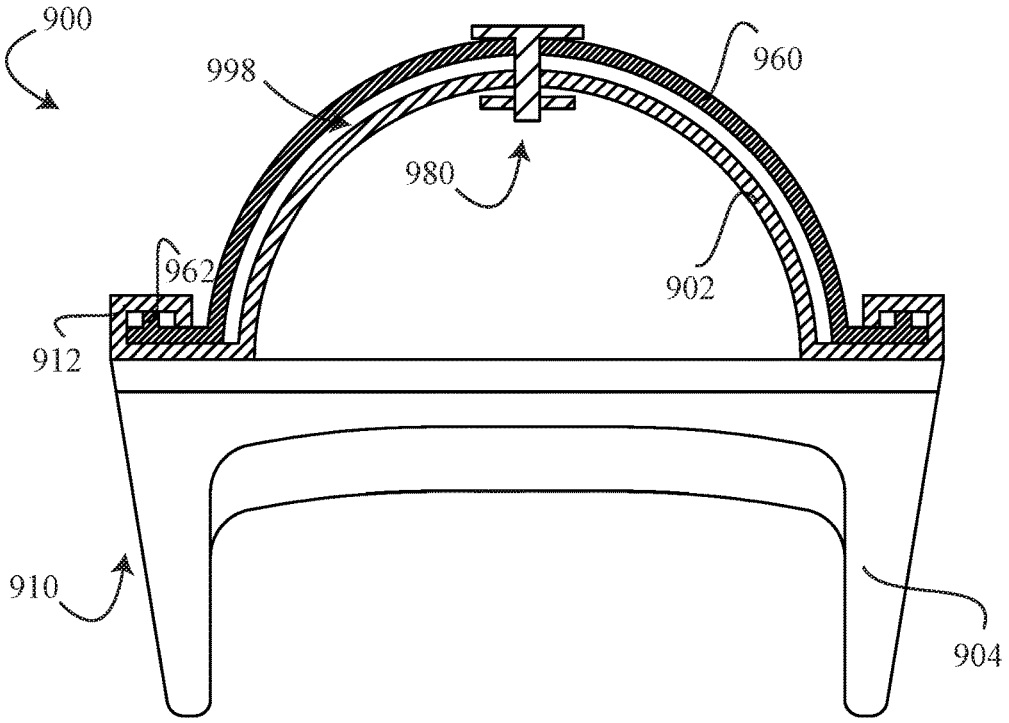
FIG. 9 shows a cross sectional view of an upper portion of a football helmet and a front view of a lower portion of the football helmet in examples of the present disclosure.

FIG. 9 shows a cross sectional view (along a direction of plane AA' of FIG. 7) of an upper portion of a football helmet 900 and a front view of a lower portion of the football helmet 900 in examples of the present disclosure. The football helmet 900 comprises a rotatable outer shell 960, a fastener assembly 980 and an inner shell 910 comprising an upper portion 902 and a lower portion 904. An air gap 988 is between the upper portion 902 of the inner shell 910 and the rotatable outer shell 960. An insert 962 of a ring shape is formed at a lower end of the rotatable outer shell 960. The insert 962 is inserted under a rim track 912 of the inner shell 910.

Figure 10:
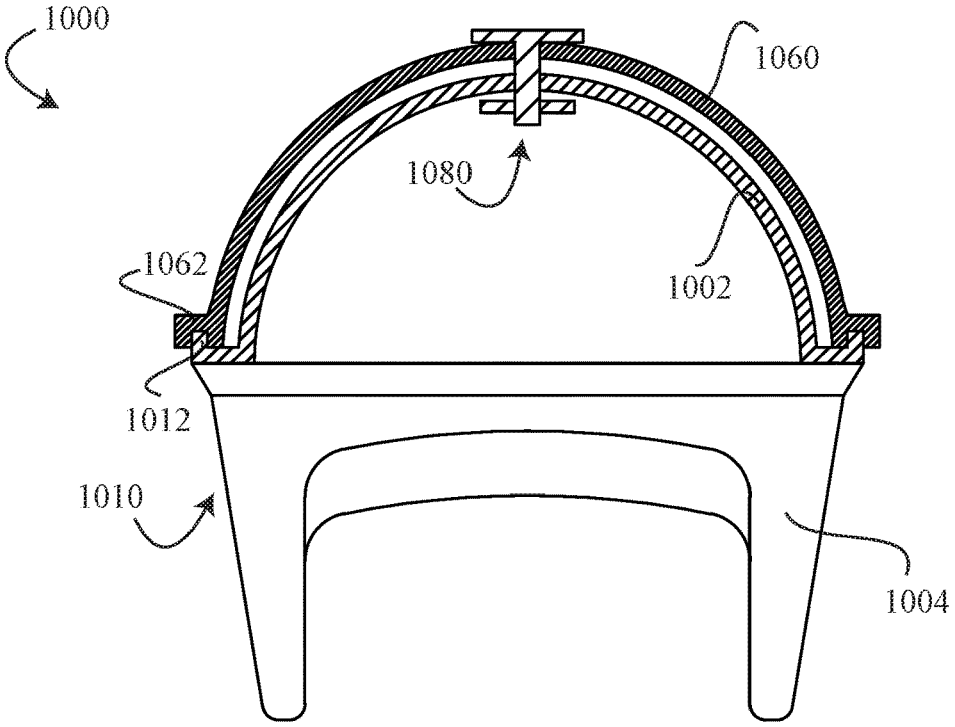
FIG. 10 shows a cross sectional view of an upper portion of another football helmet and a front view of a lower portion of the other football helmet in examples of the present disclosure.

FIG. 10 shows a cross sectional view (along a direction of plane AA' of FIG. 7) of an upper portion of a football helmet 1000 and a front view of a lower portion of the football helmet 1000 in examples of the present disclosure. The football helmet 1000 comprises a rotatable outer shell 1060, a fastener assembly 1080 and an inner shell 1010 comprising an upper portion 1002 and a lower portion 1004. A ring 1062 of a letter U shape is formed at a lower end of the rotatable outer shell 1060. The ring 1062 directly contacts and is engaged with a rim track 1012 of the inner shell 1010. A pre-determined torque is applied to a nut (for example, 1158 of FIG. 11) of the fastener assembly 1080 so that the nut is loosely tightened to a bolt (for example, 1122 of FIG. 11) of the fastener assembly 1080. The ring 1062 is rotatable along the rim track 1012. The outer shell hole (for example, 792 of FIG. 7) of the rotatable outer shell 1060 is deflectable toward the inner shell hole (for example, 892 of FIG. 8) of the upper portion 1002 of the inner shell 1010 when a force is applied to the rotatable outer shell. In examples of the present disclosure, a user may rotate the rotatable outer shell 1060 along the rim track 1012 for 360 degrees.

In examples of the present disclosure, the pre-determined torque is in a range from 10 ft-lb to 150 ft-lb. The rotatable outer shell 1060 is in a pogo stick motion when the force is applied to the rotatable outer shell 1060 so that the ring 1062 rotates along the rim track 1012 and the outer shell hole deflects toward the inner shell hole.

Figure 11:
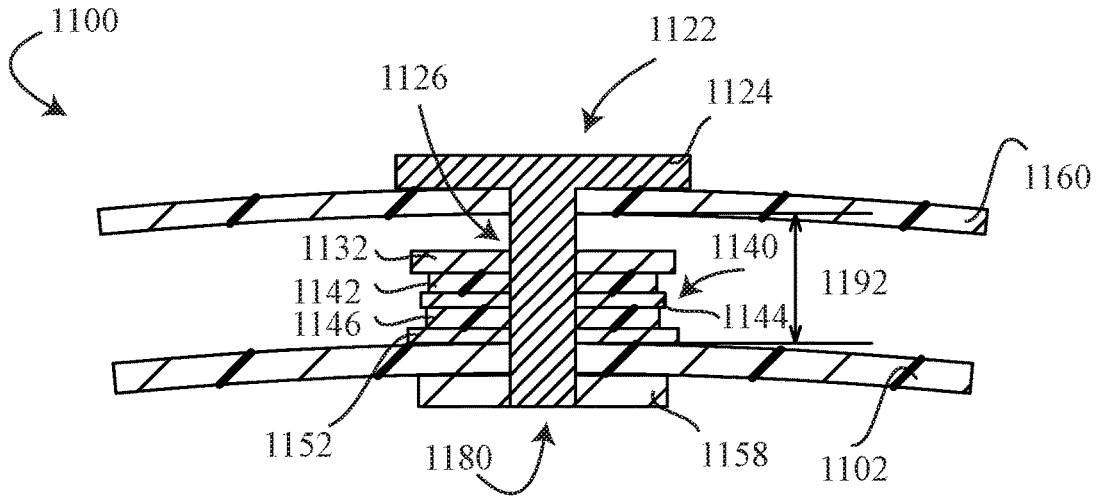
FIG. 11 shows a cross sectional view of a fastener assembly in examples of the present disclosure.

FIG. 11 shows a cross sectional view of a portion of a football helmet 1100 including a fastener assembly 1180 in examples of the present disclosure. Only a portion of a rotatable outer shell 1160 and a portion of an inner shell 1102 are shown in FIG. 11. The fastener assembly 1180 comprises a bolt 1122 having a cap 1124, an upper washer 1132, a padding 1140, a lower washer 1152 and a nut 1158. The bolt 1122 passes through the outer shell hole of the rotatable outer shell 1160, the upper washer hole of the upper washer 1132, the padding hole of the padding 1140, the lower washer hole of the lower washer 1152 and the inner shell hole of the inner shell 1102. In examples of the present disclosure, the nut is directly attached to an end of the bolt 1122.

In examples of the present disclosure, the outer shell hole is between the cap 1124 of the bolt 1122 and the upper washer hole. The upper washer hole is between the outer shell hole and the padding hole. The padding hole is between the upper washer hole and the lower washer hole. The lower washer hole is between the padding hole and the inner shell hole. The inner shell hole is between the lower washer hole and the nut 1158.

A length 1192 of a portion of the bolt 1122 between the outer shell hole and the inner shell hole is longer than a sum of a thickness of the upper washer 1132, a thickness of the padding 1140 and a thickness of the lower washer 1152 so as to allow the outer shell hole to deflect toward the inner shell hole because a section 1126 of the bolt 1122 is exposed (not surrounded by the upper washer 1132, the padding 1140 and the lower washer 1152).

In examples of the present disclosure, the padding 1140 of the fastener assembly 1180 comprises an upper rubber 1142, a metal shim 1144 and a upper rubber 1142. In examples of the present disclosure, the upper rubber 1142 and the upper rubber 1142 comprise damping materials including 3M NVH 04274. In examples of the present disclosure, a bottom surface of the upper rubber 1142 is directly attached to a top surface of the metal shim 1144. A bottom surface of the metal shim 1144 is directly attached to a top surface of lower rubber 1146.

In examples of the present disclosure, the inner shell 1102 and the rotatable outer shell 1160 are made of a molded polycarbonate material. The bolt 1122 is molded into the rotatable outer shell 1160 during a molding process. The rotatable outer shell 1160 has a recess of a circular shape to receive the cap 1124 of the bolt 1122.

Those of ordinary skill in the art may recognize that modifications of the embodiments disclosed herein are possible. For example, a number of the ventilation slots may vary. Other modifications may occur to those of ordinary skill in this art, and all such modifications are deemed to fall within the purview of the present invention, as defined by the claims.

The invention claimed is:

1. A football helmet comprising:

an inner shell having an inner shell hole, the inner shell comprising:
- an upper portion of a hollow hemisphere shape; and
- a lower portion;

a rotatable outer shell having an outer shell hole, the rotatable outer shell further having a cavity configured to accommodate the upper portion of the inner shell; and a fastener assembly comprising:
- an upper washer having an upper washer hole;
- a padding having a padding hole;
- a lower washer having a lower washer hole;
- a bolt having a cap, the bolt passing through the outer shell hole, the upper washer hole, the padding hole, the lower washer hole and the inner shell hole; and
- a nut directly attached to an end of the bolt;

wherein an air gap is between the upper portion of the inner shell and the rotatable outer shell; and wherein a ring of a letter U shape is formed at a lower end of the rotatable outer shell and wherein the ring directly contacts and is engaged with a rim track of the inner shell.

2. The football helmet of claim 1, wherein a pre-determined torque is applied to the nut so that the nut is loosely tightened to the bolt; wherein the ring is rotatable along the rim track and wherein the outer shell hole is deflectable toward the inner shell hole when a force is applied to the rotatable outer shell.

3. The football helmet of claim 2, wherein the pre-determined torque is in a range from 10 ft-lb to 150 ft-lb and wherein the rotatable outer shell is in a pogo stick motion when the force is applied to the rotatable outer shell so that the ring rotates along the rim track and the outer shell hole deflects toward the inner shell hole.

4. A football helmet comprising:

an inner shell having an inner shell hole, the inner shell comprising:

an upper portion of a hollow hemisphere shape; and a lower portion;

a rotatable outer shell having an outer shell hole, the rotatable outer shell further having a cavity configured to accommodate the upper portion of the inner shell; and a fastener assembly comprising:

an upper washer having an upper washer hole;

a padding having a padding hole;

a lower washer having a lower washer hole;

a bolt having a cap, the bolt passing through the outer shell hole, the upper washer hole, the padding hole, the lower washer hole and the inner shell hole; and a nut directly attached to an end of the bolt;

wherein an air gap is between the upper portion of the inner shell and the rotatable outer shell;

wherein the padding of the fastener assembly comprises an upper rubber member;

a metal shim; and a lower rubber member;

wherein a bottom surface of the upper rubber member is directly attached to a top surface of the metal shim; and wherein a bottom surface of the metal shim is directly attached to a top surface of lower rubber member.

* * * * *